US005993709A

United States Patent [19]

Bonomo et al.

[11] Patent Number: 5,993,709

[45] Date of Patent: Nov. 30, 1999

[54] METHOD FOR MAKING COMPOSITE BOARD USING PHENOL FORMALDEHYDE BINDER

[76] Inventors: Brian Bonomo, 151 N. Michigan Ave., #1709, Chicago, Ill. 60601; Pete Walsh, 117 S. Third St., St. Charles, Ill. 60174; Kelly Seifert, 241 Meadows Rd., Sugar Grove, Ill. 60554; Alex Vergara, 802 Manley Rd., St. Charles, Ill. 60174; Michelle Merrell, 1527 Watkins La., Apt. 206, Naperville, Ill. 60540

[21] Appl. No.: 09/103,188

[22] Filed: Jun. 23, 1998

[51] Int. Cl.[6] ..... B27N 3/12

[52] U.S. Cl. ..... 264/83; 264/109

[58] Field of Search ..... 264/83, 109, 101, 264/102

[56] References Cited

U.S. PATENT DOCUMENTS

| | | | |
|---|---|---|---|
| 3,649,396 | 3/1972 | Carlsson . | |
| 4,393,019 | 7/1983 | Geimer | 264/83 |
| 4,514,532 | 4/1985 | Hsu et al. | 524/14 |
| 4,850,849 | 7/1989 | Hsu et al. | 425/407 |
| 4,897,314 | 1/1990 | Clarke et al. | 428/529 |
| 4,937,024 | 6/1990 | Hickson | 264/83 |
| 5,217,665 | 6/1993 | Hsu et al. | 264/83 |
| 5,246,652 | 9/1993 | Hsu et al. | 264/109 |
| 5,629,083 | 5/1997 | Teodorczyk | 428/308.8 |

OTHER PUBLICATIONS

W. Ernest Hsu, A Practical Steam Pressing Technology for Wood Composites, Proceedings of the Washington State University\ International Particleboard/Composite Materials Series Symposium; Publ by Washington State Univ., Pullman, WA, USA, pp. 69–82, Ap. 10–11, 1991.

Geimer & Christiansen, Critical Variables in the Rapid Cure and Bonding of Phenolic Resins, Forest Products Journal, vol. 46, No. 11/12, pp. 67–72, Nov./Dec. 1996.

"Alta Goldboard Limited Partnership", Understanding Gluing Phenol–Formaldehyde (PF) Resin, (Manufacturer's information publication) http;//www.goldboard.com/pfresin.htm, Aug. 19, 1997.

W. Ernest Hsu, Comparison of Fiberboards Bonded with PF and UF Resins (conference abstract) S5.05–01, Wood based Composites, http://www.metla.fi/conf/iufro95abs/d5pap62.htm, Oct. 8, 1995.

*Primary Examiner*—Mary Lynn Theisen
*Attorney, Agent, or Firm*—Darby & Darby

[57] ABSTRACT

Wood composite boards are produced from a wood fiber treated with a slow curing, low alkalinity phenol formaldehyde (PF) resin. The resin treated wood fiber is consolidated and cured in a press using steam injection. The slow curing nature of the resin prevents pre-cure of the resin. The press using steam injection speeds curing so that boards can be produced in press cycles comparable to the curing of wood fiber treated with other resins in a press with no steam injection.

15 Claims, No Drawings

METHOD FOR MAKING COMPOSITE BOARD USING PHENOL FORMALDEHYDE BINDER

FIELD OF THE INVENTION

The present invention relates generally to methods for making a composite board, such as, particleboard, fiberboard, chip board or the like, and more particularly to a method for making composite board using phenol formaldehyde binder. The board is made from wood particles, chips and/or fibers treated with a curable or hardenable phenol formaldehyde resin.

BACKGROUND OF THE INVENTION

Composite wood products, such as board, may be formed by consolidating a loose mat of lignocellulosic materials under heat and pressure, until the individual lignocellulosic elements adhere together to form a solid wood-like product. The lignocellulosic materials may take the form of wood materials, such as, particles, chips, fibers and/or the like and it will be understood that these terms are used interchangeably herein. Typically, the materials forming the mat are treated with a binder, such as a resin, before heat and consolidation are applied, to enhance adherence of the materials and improve the resulting properties of the finished product.

Consolidation of the mat is generally conducted in a press. A conventional press for consolidating a binder treated wood composite mat to a particular molded shape, such as, for example, a board, includes two opposing press platens spaced to define a mold cavity. At least one platen is heated through conduction, such as through the use of electric heating coils or by passing a heated fluid or gas medium, such as steam, through conduits heating coils or by passing a heated fluid or gas medium, such as steam, through conduits located in the platen body. Upon contact with the mat, heat is transferred from the platen to the mat by conduction. This process is known as hot pressing.

Urea formaldehyde (UF) resin or isocyanate (MDI) resin have typically been the binder of choice in hot pressing of composite wood products due to lower curing temperatures, reasonably short press cycles and superior properties imparted to the finished product in the short press cycles. Recently, due to significantly lower cost in use, attention has been directed to methods using phenol formaldehyde (PF) resins. However, the properties of composite products hot pressed with PF resins are inferior to those made with UF or MDI resins, and the press time for PF resins is typically found to be significantly longer.

Thus, it is known that certain resins having, for example, rapid curing rates or high curing temperatures, yield composite wood products with inferior properties when produced in a conventional press by hot pressing. U.S. Pat. No. 4,850,849 to Hsu et al. discloses that prior art presses are not capable of producing sufficiently high temperatures within a reasonable time frame to achieve curing of binders such as phenol formaldehyde resin. Additionally, it is believed that the slow transfer of heat by conduction from a conventional platen to a mat, particularly a thick mat, causes temperature differentials across the thickness of the mat. The temperature differentials may cause, for example, resin and fibers at or near the surface of the mat adjacent to the heated platen to be exposed to excessive heat, while materials at the core of the mat may be exposed to insufficient heat. The temperature differential across the thickness of a mat during curing in a conventional press can thus lead to over-curing and/or under-curing of portions of the thickness of the mat, resulting in structural and/or aesthetic flaws in the finished product. Resins with rapid curing rates or high curing temperatures are particularly susceptible to the negative effect on resin curing of temperature differentials across the thickness of the mat. For the foregoing reasons, phenol formaldehyde resins generally have been considered unsuitable for producing thick composite board products in a conventional press.

Also, although conventional presses have been successful in making fiberboard products using only conduction heat (hot pressing), today's manufacturing demands require faster cycle times on the press and the use of stronger high-temperature resins to produce highly detailed, higher density, and thicker fiberboard products. It is known that some of the disadvantages of conventional platens can be overcome by supplying, or injecting, steam directly into a mat through modified press platens provided with steam injection ports for that purpose. This is generally known as "steam injection" pressing. The steam passes from the injection ports into interstitial spaces between the wood particles, chips and/or fibers forming the mat, thus carrying heat quickly and uniformly to the core of the mat. Steam injection pressing has several advantages. Steam injection pressing speeds the curing of typically dimensioned boards using conventional resins, thus significantly shortening press cycles. Steam injection pressing also permits the use of high temperature curing resins, which are not typically suitable for use in conventional pressing, and which may be cheaper, safer and/or result in a stronger bonded product. And steam injection permits consolidation and curing of relatively thick composite boards, which either do not properly cure in a conventional press or do not cure quickly enough to provide a cost competitive product. Thus, steam injection is known to speed curing of resins improve product quality and shorten production time for wood composite products, particularly products having thick dimensions.

The benefits and advantages of steam injection can be significantly enhanced by conducting the injection in a sealed press, i.e., a press that isolates the press cavity from the surrounding atmosphere. This can be accomplished by sealing the perimeter of the cavity. Alternatively, the entire press can be isolated in a sealed chamber. A sealed press significantly reduces or eliminates the loss of valuable steam and facilitates the injection of steam into the mat at elevated pressures.

Relative to binders that cure at moderate temperatures, such as urea formaldehyde resin (UF) or isocyanate resin (MDI), phenol formaldehyde resin binders require high temperatures for curing, and consequently require a longer press cycle to effect curing throughout the thickness of a composite board profile. Because press cycle time is considered to be a major factor in determining the economy of manufacture of wood composite products, resins requiring longer press cycle times have been avoided due to the additional time required to cure the resin. It was thought that the longer press cycles necessitated by the high curing temperature of a resin could be counteracted by rapidly heating a fast-curing resin with steam injection, or with pre-heating followed by steam injection to cure the resin. However, rapid heating, either by high pressure steam injection, or by a combination of pre-heating and high pressure steam injection, is known to cause fast-curing resin to pre-cure.

It is known that the use of a slower curing resin prevents pre-cure of the resin in process equipment adapted to treat wood fibers with resin prior to formation of a mat for consolidation. U.S. Pat. No. 5,629,083 to Teodorczyk discloses the formation of composite wood products with a slow curing PF binder to prevent pre-cure in a blowline process for resin application to wood fibers before mat formation.

A journal publication by Ernest W. Hsu titled *A Practical Steam Pressing Technology for Wood Composites,* Proceedings of the Washington State University International Particleboard/Composite Materials Symposium, Pullman, Wash., Apr. 10, 1991, discloses that high-temperature curing resins, such as phenol formaldehyde resins, can be cured in a reasonable range of press times by steam injection in a sealed press. A conference abstract attributed to Ernest W. Hsu titled *Comparison of Fiberboards Bonded with PF and UF Resins* (1995), discloses that press times for phenol formaldehyde resin bonded fiberboard can be substantially reduced, and thus can be made comparable to UF-bonded fiberboard, by manipulating fiber mat temperatures, molecular weight distribution of PF resins and pressing parameters.

Pre-heating a wood composite mat is known to reduce press time and to prevent pre-cure of surface layers of the mat in the press cycle. U.S. Pat. No. 3,649,396 to Carlsson discloses preheating of furnish with a steam saturated air stream to a temperature close to the curing temperature of the binder to shorten press time, and to prevent premature curing of mat surface layers in the press. Carlsson also teaches that pre-cure is to be avoided in preheating.

U.S. Pat. No. 5,246,652 to Hsu et al. discloses that good bonding strength of a phenol formaldehyde binder can be achieved by steam injection. The Hsu et al. '652 patent discloses a method for making phenol formaldehyde resin bonded wood composites with improved resistance to biological attack and fire. The Hsu '652 patent does not distinguish between slow and fast curing phenol formaldehyde resins.

Despite the indication by Hsu that good bonding strength of a phenol formaldehyde binder can be achieved by steam injection, and that high-temperature curing resins can be cured in a reasonable range of press times by steam injection, the use of phenol formaldehyde resins in steam pressing has been found to be generally unsatisfactory, particularly in commercial applications. The generally unsatisfactory results are attributed to low or inconsistent internal bond strength of the consolidated product (see Lim et al. in U.S. Pat. No. 5,217,665).

As noted above, phenol formaldehyde resins are significantly less expensive to use. Thus, there is a need for a method for making composite board products using phenol formaldehyde resin in a reasonable press time such that the products consistently have suitable properties, such as, for example, high internal bond strength, dimensional stability, durability, etc.

SUMMARY OF THE INVENTION

The present invention is a method of producing wood composite boards, particularly exterior grade boards, from wood fiber treated with a slow curing, low alkalinity phenol formaldehyde (PF) binder. The method includes the steps of forming a mat from wood fiber treated with a slow curing, low alkalinity phenol formaldehyde binder, preheating the mat, and curing and consolidating the treated mat by a combination of high pressure steam injection, platen heat and platen pressure. In the present invention, pre-cure is avoided by using a slow curing PF resin, while short press cycles are achieved by counteracting the slow cure rate and high curing temperature of the PF resin with the rapid heat transfer of high pressure steam injection. Press cycles may be further shortened by preheating the mat. Thus, PF bonded composite board can be produced in press cycles comparable to UF or MDI bonded board.

DETAILED DESCRIPTION

In accordance with the present invention, a wood composite board is produced from a mat formed of wood fibers treated with a slow curing, low alkalinity phenol formaldehyde (PF) binder. The mat is cured and consolidated in a press cycle including preheating followed by steam injection.

Wood fiber produced by conventional means is treated with an uncured, slow curing, low alkalinity phenol formaldehyde resin. Examples of suitable commercially available resins include GP99C28 and GP58C38, both manufactured by Georgia Pacific Co. of Atlanta, Ga. GP58C38 in particular exhibited good results.

In the preferred embodiment, the resin has a curing temperature of 380° C. However, resin curing temperature is influenced by variables including but not limited to the type of material treated, the particle size, the mat thickness, moisture content, etc. In the context of this invention, a slow curing resin is a resin having a boiling water gel time greater than 20 minutes. The boiling water gel time is determined by a standard resin test which measures the resin cure rate at 212° F. The boiling water gel time is used to establish the relative cure rates of various resin types and formulations. However, the curing rate of a particular resin is influenced by external factors including, the materials to which it is applied, the thickness of the resin coating, the thickness of the article being cured, moisture, etc. Thus, a slow curing PF resin could have a boiling water gel time of somewhat less than 20 minutes. Preferably, the boiling water gel time is in the range of 20–60 minutes.

The resin preferably has an alkalinity less than 2.5% to provide low water absorption properties to the resulting composite board. The resin has a pH less than 10.

The resin treated lignocellulosic material is formed into a fibrous mat. The fibrous mat is loaded into a press adapted for steam injection. Preferably the press is of the type having a press cavity defined between opposite press platens. The press platens are heated to a temperature higher than the curing temperature of the resin. Additionally, at least one of the press platens is adapted to permit steam injection.

Preferably, the fibrous mat is pre-heated to a temperature of 212° F. (100° C.) or more to prevent condensation of subsequent steam applications in the mat. The fibrous mat may be pre-heated, by for example, exposing the mat to a hot gas, such as steam, in a pre-heating chamber before loading the mat in the press. Alternatively, the mat may be loaded into the press cavity and pre-heated by exposure to steam or by conduction of heat from the press platens forming the press cavity. In a first in-press pre-heating operation, the press remains open while low pressure steam is introduced to the bottom of the mat until the top surface of the mat reaches a temperature of 212° F., indicating steam penetration through the thickness of the mat. Alternatively the press cavity is sealed and the mat is subjected to a period of hold time while heat is conducted from the press platens to the mat to convert moisture in the mat to steam. Subsequent venting of steam pressure build-up in the mat purges the mat of excess moisture and air, and assures that heat permeates uniformly through the thickness of the mat preferably to raise the temperature of the mat to at least 212° F. In another alternative pre-heating method, the press cavity is sealed and the mat is subjected to a burst of low pressure steam, e.g. 50 psi. Again, subsequent venting of the steam pressure build-up in the mat purges the mat of excess moisture and air, and assures that the heat supplied by the low pressure steam permeates uniformly through the thickness of the mat preferably to raise the temperature of the mat to at least 212° F.

This initial pre-heating of the mat is followed, in a sealed, closed press, by a high pressure steam injection cycle sufficient to cure the PF resin. In the preferred embodiment, steam is supplied at a pressure of 200 psi for 50–90 seconds to bring the temperature of the mat to 380° F. However, the steam may be supplied at a pressure of 100 psi or greater for 30–120 seconds. The mat may be consolidated under pressure either before, during or after the high pressure steam injection. The timing of the consolidation under pressure relative to the high pressure steam injection is selected to yield a desired density profile through the thickness of the board. A uniform density profile is obtained by injecting steam into the mat prior to press closure. A density profile exhibiting high density surfaces on a lower density core is obtained by injecting steam after the mat is fully consolidated. By controlling the timing of the steam injection relative to the timing of the pressure consolidation any number of density profiles can be obtained.

After consolidation and curing of the resin, the sealed press is vented to relieve steam pressure build-up in the consolidated and cured mat. The press is opened and the composite board is removed.

Sample half inch thick boards were prepared in a conventional press by known methods, and in a sealed press using PF resin according to the method of the present invention. A comparison of the properties is summarized in Table 1 below. The American Hardboard Association standards are listed in the right hand column of the table.

TABLE 1

| | Sealed pressing | Conventional pressing | American Hardboard Association |
|---|---|---|---|
| one hour boil swell | <15% | <30% | none |
| 24 hour water absorption | <10% | <10% | <12 |
| 24 hour caliper swell | <5% | <5% | <8 |
| specific gravity (g/cc) | 80 | 90 | |
| press time (minutes | 3 | 6 | |
| humidification required | no | yes | |
| not resistance | yes | no | |
| MOR psi | 5000 | 5000 | >1800 |
| MOE psi | 250 | 250 | |

The "one hour boil swell" is a test used by the inventors to determine the relative durability of a composite board product by calculating the percentage of change in the thickness of the board after submerging a 1 inch by 12 inch sample of the board in boiling water for one hour. After removal from the boiling water, the thickness of the board sample is measured and compared to the thickness of the board sample prior to boiling. The difference between the measurements is used to calculate a percentage of change.

The results of the comparative data in Table 1 demonstrate that sealed pressed product samples made with PF resin according to the present invention exhibited significantly improved (lower) boil swell and rot resistance, lower specific gravity (density), the reduction or elimination of post press humidification, and significantly shorter press time.

The reduction or elimination of post-press humidification is an important advantage of the present invention over conventional pressing. Fluctuations in the moisture content of a composite board product after manufacture are known to cause undesirable dimensional changes, such as, for example, linear expansion or buckling of the product. During typical end use exposures, products pick up and lose moisture based on environmental factors, such as, for example, humidity, rain, drought, etc. To avoid undesirable dimensional changes in an end use exposure, typically, composite board products are humidified after conventional methods of pressing to increase the average moisture content of the product to a level suitable for a particular geographic or climatic area in order to minimize moisture content fluctuation. Post-press humidification adds moisture content to composite board products. Post-press humidification is particularly important for products produced in conventional hot platen pressing, which have substantially all of the moisture "cooked out" during pressing, and thus exit the press with nearly 0% moisture.

The ideal moisture content of composite wood products should typically be 7% (with a range of 2%) in environmentally dry areas and 12% or more in environmentally wet areas. As noted above, boards produced according to the present invention have a moisture content of 4–8%. Thus, boards produced according to the present invention are particularly suitable for interior or exterior applications in a variety of climates with little or no post-press humidification. Applications contemplated for the board products include, but are not limited to, trimboard, fencing, siding, decking, window and door components, case good substrate for the furniture industry, pallets and containers, interior molding and millwork, ornamental products such as gazebos, shutters, and wall paneling and wall systems. It will be understood that numerous other applications, though not specifically mentioned, are also contemplated.

Although preferred embodiments of the invention have been disclosed for illustrative purposes, those skilled in the art will appreciate that many additions, modifications and substitutions are possible without departing from the scope and spirit of the invention as defined by the accompanying claims.

What is claimed is:

1. A method for making a composite wood product, comprising the steps of:

forming a mat comprising wood particles treated with an uncured, slow-curing phenol formaldehyde binder, the binder having an alkalinity less than 2.5% and a pH less than 10;

consolidating the mat;

supplying a quantity of steam to the mat at a pressure and for a period of time sufficient to cure the binder; and venting excess pressure from the mat.

2. A method for making a composite wood product, comprising the steps of:

forming a mat comprising wood particles treated with an uncured, slow-curing phenol formaldehyde binder, the binder having an alkalinity less than 2.5% and a pH less than 10;

placing said mat in a press cavity defined between first and second press platens;

sealing the press cavity;

consolidating the mat by moving at least one of the first and second press platens toward the other of the first and second press platens;

supplying a quantity of steam to the mat through at least one steam port, said quantity of steam supplied at a pressure and for a period of time sufficient to cure the binder;

venting excess pressure from the mat before unsealing the press cavity; and opening the press cavity.

3. A method for making a composite wood product, comprising the steps of:

forming a mat comprising wood particles treated with an uncured slow-curing phenol formaldehyde binder, the binder having an alkalinity less than 2.5% and a pH less than 10;

placing said mat in a press cavity defined between first and second press platens;

closing the press cavity;

consolidating the mat fully by moving at least one of the first and second press platens toward the other of the first and second press platens to a final compression position;

supplying a first quantity of steam to the mat through at least one steam port in the first press platen, said first quantity of steam supplied at a pressure in the range of 25 to 75 psi and for a period of time in the range of 30 to 120 seconds;

venting said first quantity of steam from the mat through said at least one steam port in said first press platen such that excess air is purged from the mat;

supplying a second quantity of steam to the mat through the at least one steam port in the first press platen, the second quantity of steam supplied at a pressure in the range of 100 to 250 psi and at a temperature sufficient to cure the binder;

venting excess pressure from the mat before opening the press cavity; and opening the press cavity.

4. A method for making a composite wood product, comprising the steps of:

forming a mat comprising wood particles treated with an uncured, slow-curing phenol formaldehyde binder, the binder having an alkalinity less than 2.5% and a pH less than 10;

preheating the mat;

consolidating the mat in a press cavity; and supplying a quantity of steam to the mat at a pressure and a temperature and for a period of time sufficient to cure the binder.

5. The method for making a composite wood product according to claim 4 further comprising the step of venting excess pressure from the mat after the binder is cured.

6. The method for making a composite wood product according to claim 4 further comprising the step of sealing the press cavity before the mat is consolidated.

7. The method for making a composite wood product according to claim 6 further comprising the step of venting the press cavity after the mat is consolidated.

8. The method for making a composite wood product according to claim 4 wherein the step of preheating further comprises the step of exposing the mat to steam in a pre-heating chamber.

9. The method for making a composite wood product according to claim 4 wherein the step of preheating further comprises the steps of positioning the mat in the press cavity and providing an amount of steam to the mat.

10. The method for making a composite wood board according to claim 9 wherein the amount of steam is provided at an elevated pressure.

11. The method for making a composite wood board according to claim 9 wherein the amount of steam is provided at a pressure less than 100 psi.

12. The method for making a composite wood board according to claim 9 wherein the amount of steam is provided at a pressure of 50 psi.

13. The method for making a composite wood product according to claim 4 wherein the quantity of steam is provided at a pressure equal to or greater than 100 psi for a period of 30–120 seconds.

14. The method for making a composite wood product according to claim 4 wherein the quantity of steam is provided at a pressure of 200 psi for a period of 50–90 seconds.

15. The method for making a composite wood product according to claim 4 wherein the quantity of steam is provided at a pressure and for a period of time sufficient to bring the temperature of the mat to 380° F.

* * * * *

Disclaimer 5,993,709—Brian Bonomo, Chicago; Pete Walsh, St. Charles; Kelly Seifert, Sugar Grove; Alex Vergara, St. Charles; Michelle Merrell, Naperville; all of Ill. METHOD FOR MAKING COMPOSITE BOARD USING PHENOL FORMALDEHYDE BINDER. Patent dated November 30, 1999. Disclaimer filed January 7, 2002, by the assignee, Masonite Corporation.

Hereby enters this disclaimer to claim 3 of said patent.

*(Official Gazette May 21, 2002)*